United States Patent [19]

Guitel et al.

[11] Patent Number: 4,558,884

[45] Date of Patent: Dec. 17, 1985

[54] REAR ELEMENT FOR A SKI BINDING

[75] Inventors: Jean-Claude Guitel, Nevers; Daniel le Faou, Varennes Vauzelles, both of France

[73] Assignee: Ste Look, Nevers, France

[21] Appl. No.: 600,012

[22] Filed: Apr. 13, 1984

[30] Foreign Application Priority Data

May 17, 1983 [FR] France ..... 83 08116

[51] Int. Cl.[4] ..... A63L 9/082

[52] U.S. Cl. ..... 280/620; 280/624

[58] Field of Search ..... 280/613, 617, 618, 620, 280/628, 633, 636

[56] References Cited

FOREIGN PATENT DOCUMENTS 2258905 6/1974 Fed. Rep. of Germany ..... 280/636

1363895 9/1964 France .

*Primary Examiner*—David M. Mitchell

*Assistant Examiner*—Richard M. Camby

*Attorney, Agent, or Firm*—Young & Thompson

[57] ABSTRACT

The axis of rotation of a plate which carries the heel-holding member of a ski binding is forwardly inclined at an angle approximately between 8° and 20° with respect to a vertical axis perpendicular to the top ski face. This angle of slope is close in value to the forward slope imposed on the skier's tibia by the shape of the ski boot. The top surface of the rotary plate nevertheless remains parallel to the top ski face.

3 Claims, 3 Drawing Figures

REAR ELEMENT FOR A SKI BINDING

This invention relates to a rear safety ski binding of the type in which the heel-holding member is carried by a plate which is intended to serve as a bearing surface for said member and is mounted so as to be capable of rotating about its center.

This type of element, commonly designated as a "rear pivot", is described for example in U.S. Pat. No. 3,249,365. Rear pivots of this type offer a certain number of important advantages over ski bindings in which the heel-holding member is mounted in a fixed position on the ski.

The chief advantage of these pivots lies in the fact that, during a release in torsional motion, the ski boot is permitted to rotate on the ski about an axis which is close to the natural axis of the leg as materialized by the axis of the tibia. Thus the torque developed in the skier's leg is practically constant irrespective of the location along the ski of the point of application of the force which has caused a ski-boot release.

On the contrary, in the case of a stationary heel-holding device, the ski boot is caused to pivot about a point located at the level of the heel and the value of stress developed in the skier's leg varies with the position of the point of application of the force.

A further inherent advantage of rear pivots lies in the fact that these latter are provided with lateral packing-pieces which are clamped against the sole in the region of the tibia. Under these conditions, the impulses exerted by the skier for controlling the corresponding ski are transmitted directly to this latter without any attendant danger of accidental ski-boot release. On the other hand, in the case of a ski binding without a pivot, the boot is held on the ski only at its two ends, with the result that the boot is liable to escape accidentally either on one side or the other under the action of strong lateral impulses.

However, the main advantage of rear pivots lies in the fact that, in the event of release, the ski boot is permitted to rotate about an axis which is close to the axis of the tibia. In the case of modern ski boots, however, a relative angular displacement exists between the axis of the tibia and that of the pivot. This arises from the fact that ski boots of current designs are provided with a boot-upper having a top portion which is inclined in the forward directon with respect to the bottom portion. This forward slope or so-called "ski-boot advance" is intended to assist the skier in taking up the correct skiing position with both knees slightly bent.

The angle of slope thus contemplated is usually within the range of 13° to 17° with respect to the axis of the pivot whereas the pivot itself is perpendicular to the surface of the ski. However, since the top portion of each boot-upper is joined to the bottom of this latter by means of a flexible or articulated joint, this angle of slope can attain a value of 25° to 30° in the position of maximum flexion. In consequence, the axis of the tibia is angularly displaced with respect to the axis of the pivot, with the result that, during a torsional ski-boot release, the torque induced in the skier's leg exceeds the value which would be attained of these two axes were in coincident relation. Furthermore, this value of torque increases in inverse ratio to the cosine of the boot-advance angle and is liable to rise in a proportion which is not negligible when the boot-advance angle is large.

The object of the present invention is to solve this problem by providing a pivot so designed that the relative angular displacement between the pivot axis and the axis of the tibia is reduced as far as possible.

To this end, said pivot is essentially distinguished by the fact that the axis of rotation of the corresponding plate is inclined in the forward direction at an angle approximately within the range of 8° to 20 ° with respect to a vertical axis perpendicular to the top surface of the ski. Ths angle of inclination consequently comes close in value to the angle of slope assumed by the skier's tibia as a result of the shape of a ski boot. The top surface of said rotary plate is nevertheless substantially parallel to the top surface of the ski.

One form of construction of a pivot of this type is described hereinafter with reference to the accompanying drawings, wherein.

Figure 1:
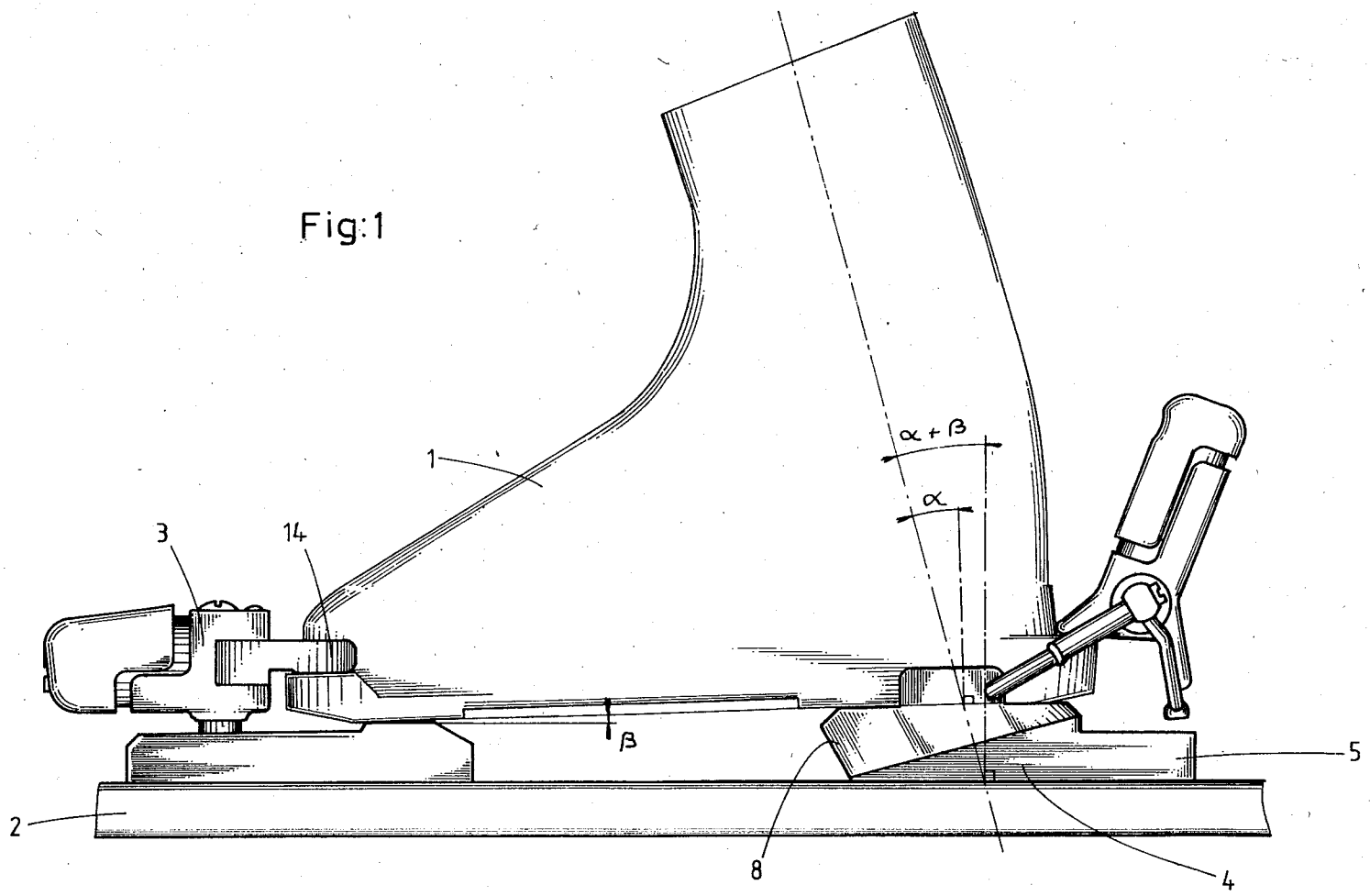
FIG. 1 is a view in side elevation of a ski boot fixed on a ski by means of a toe abutment member of a conventional type and by means of a rear ski-binding element consisting of a pivot in accordance with the invention.

As already mentioned, the ski boot 1 shown in FIG. 1 is fixed on a ski 2 by means of a toe abutment member 3 of conventional type and by means of a rear ski-binding element consisting of a pivot in accordance with the invention. This pivot comprises a fixed plate 4 which is provided with a rear extension 5 and is directly fixed on the ski by means of screws 6. The top face 7 of said base plate which is fowardly inclined with respect to the top face of the ski serves as a bearing surface for a rotary plate 8 which constitutes the pivot proper.

Figure 2:
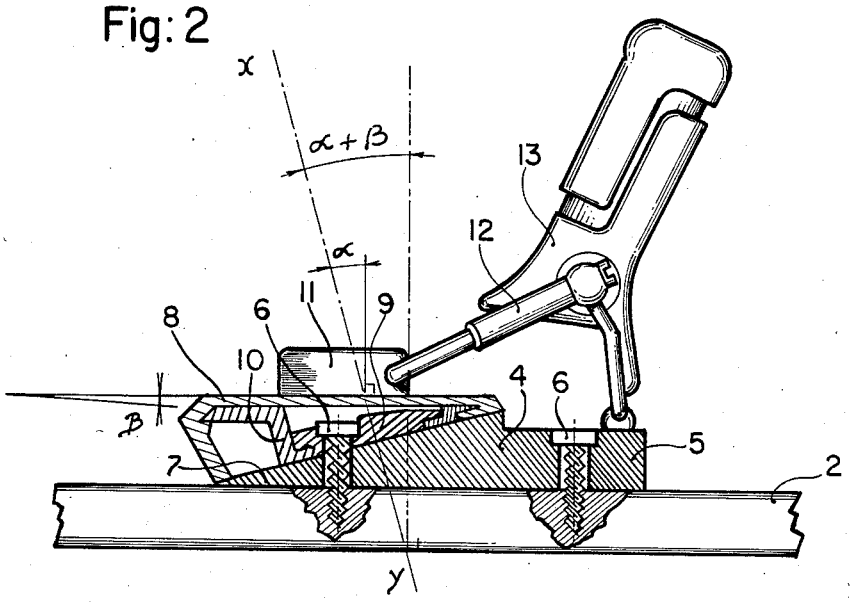
FIG. 2 is a view in side elevation showing the corresponding pivot.
Figure 3:
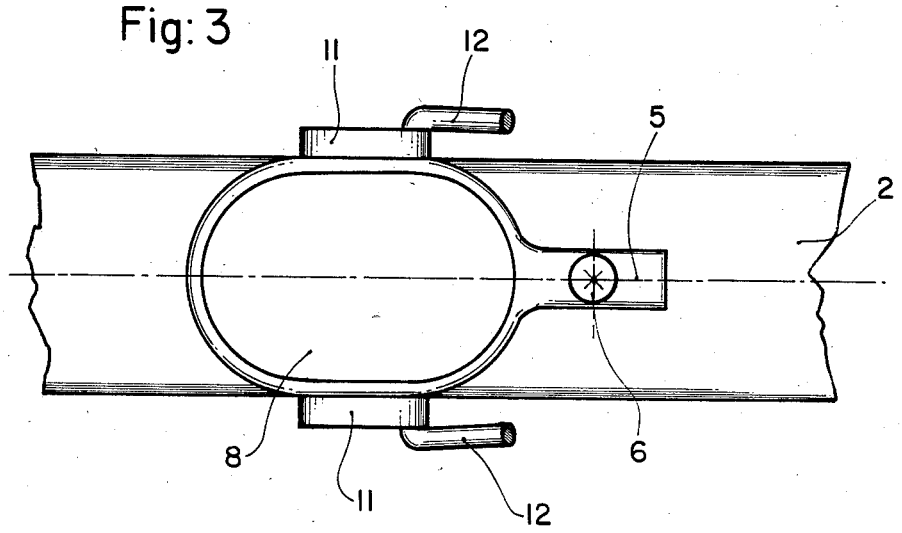
FIG. 3 is a plan view of the pivot in which the heel-holding member has been suppressed for the sake of enhanced clarity of the drawings.

As shown in FIG. 2, said plate is hollow and is attached to the top face 7 of the fixed base plate 4 by means of a cup-shaped member 10 housed within said hollow rotary plate. Said member is in turn secured to the base plate 4 by means of a disk 9 which is fixed on the latter. Said disk is engaged within a circular opening formed in the bottom of said member 10 and is provided with an annular retaining flange. Said disk thus virtually serves as a rotational bearing for the rotary plate 8.

As a result of the arrangement thus provided, said plate 8 is capable of rotating about an axis X—Y which passes through the center of the fixed retaining disk 9 and which is perpendicular to the top surface 7 of the base plate 4. In consequence, said axis is inclined in the forward direction with respect to a vertical axis perpendicular to the surface of the ski. However, the top surface of the rotary plate 8 is in turn parallel or approximately parallel to the top surface of the ski in order to serve as a bearing surface for the heel of the ski boot 1.

In the usual manner, the rotary plate 8 is adapted to carry two vertical flanges 11 which form retaining brackets on each side of the heel of the ski boot 1. Said vertical flanges are intended to serve as supporting elements for a stirrup member 12 which carries a heel-retaining pivotal member 13.

In the example shown in the drawings, the axis X—Y of pivotal displacement of the rotary plate 8 makes an angle $\alpha$ of 14° with respect to a line perpendicular to the top face of said plate. This angle thus corresponds approximately to the angle of advance of the boot-upper in the majority of modern ski boots.

However, in accordance with customary practice, the ski-boot face which bears on the ski binding is in turn slightly inclined in the forward direction at an angle $\beta$ of 2°, for example, with respect to the top face of the ski. Under these conditions, the angle of inclination of the axis X—Y of the pivot with respect to a vertical line perpendicular to the top surface of the ski is equal to $\alpha+\beta$, namely an angle of 16°.

However, the existence of an angle of slope having this value consequently entails the need to provide a base plate 4 of relatively substantial thickness so as to constitute a vertical wedge beneath the rotary plate. In consequence, the ski boot is located at a higher level with respect to the top surface of the ski, which can be a disadvantage for some skiers.

In order to circumvent this drawback, the angle of slope $(\alpha+\beta)$ can be limited to a value of the order of 8° to 10° although this latter does not correspond to the ideal angle of slope.

It is also worthy of note that, as a result of the slope of the axis X—Y of the rear pivot under consideration, the path followed by the toe of the ski boot at the time of rotational release of this latter is not flat but conical since in such a case its outer edge rises to a slight extent.

For this reason it is preferable to employ the pivot under consideration in combination with a toe abutment member 3 having a jaw unit 14 which is capable of moving not only in the lateral direction but also in the vertical direction.

By way of example, this toe abutment member can be of the type described in U.S. Pat. No 3,909,030 or in U.S. Ser. No. 518,938.

This makes it possible to forestall any danger of jamming of the toe end of the ski boot within the toe abutment member at the time of rotational release of this latter.

With the same objective, however, the ski boot can also be supported by means of a bearing plate or slide-plate having predetermined freedom of angular displacement which permits pivotal movement about a longitudinal axis in oposition to resillient means for restoring the boot to its normal position.

It is in any case readily apparent that the rear pivot in accordance with the invention is not limited solely to the example of construction described in the foregoing. Thus it would be possible to provide different means for mounting the rotary plate on the ski and in particular different means for holding said plate in position.

What is claimed is:

1. A rear ski-binding element for fixing a ski boot on a ski, comprising a heel-holding member carried by a plate which serves as a bearing surface for said member, and means mounting said plate for rotation about its center, the axis of rotation of said plate being forwardly inclined at an angle approximately within the range of 8° to 20° with respect to a vertical axis perpendicular to the top surface of the ski so that this inclination comes close in value to the angle of slope assumed by the skier's leg as a result of the shape of a ski boot, the top surface of said rotary plate being substantially parallel to the top surface of the ski.

2. A ski-binding element according to claim 1, wherein the rotary plate rests on the top of a base plate which is adapted to be fixed on the ski and the top face of which is forwardly inclined at an angle approximtely within the range of 8° to 20° with respect to the top surface of the ski.

3. A ski-binding element according to claim 2, wherein the rotary plate is hollow and contains a cup-shaped member for attaching said rotary plate to the top face of the fixed base plate by means of a disk separately mounted on said base plate and having the function of a bearing for said rotary plate, said disk being engaged within a circular opening formed in the bottom of said cup-shaped member.

* * * * *